US008840154B2

(12) United States Patent
Wilms et al.

(10) Patent No.: US 8,840,154 B2
(45) Date of Patent: Sep. 23, 2014

(54) MOTOR VEHICLE DOOR LOCK

(75) Inventors: Dirk Wilms, Duisburg (DE); Frank Kunst, Lüdinghausen (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 409 days.

(21) Appl. No.: 12/667,685

(22) PCT Filed: Jul. 3, 2008

(86) PCT No.: PCT/DE2008/001110

§ 371 (c)(1),
(2), (4) Date: May 26, 2010

(87) PCT Pub. No.: WO2009/003465

PCT Pub. Date: Jan. 8, 2009

(65) Prior Publication Data

US 2010/0236300 A1 Sep. 23, 2010

(30) Foreign Application Priority Data

Jul. 5, 2007 (DE) ..... 20 2007 009 441 U

(51) Int. Cl.

| | |
|---|---|
| ***E05C 3/06*** | (2006.01) |
| ***E05B 81/06*** | (2014.01) |
| *E05C 3/16* | (2006.01) |
| *E05B 85/26* | (2014.01) |

(52) U.S. Cl.

CPC ..... *E05B 81/06* (2013.01); *E05B 85/26* (2013.01); *Y10S 292/23* (2013.01)

USPC ..... 292/201; 292/216; 292/DIG. 23

(58) Field of Classification Search

USPC ..... 292/201, 216, 336.3, DIG. 23

See application file for complete search history.

(56) References Cited

U.S. PATENT DOCUMENTS

| | | | | |
|---|---|---|---|---|
| 4,364,249 | A * | 12/1982 | Kleefeldt | 70/264 |
| 4,978,154 | A * | 12/1990 | Kleefeldt et al. | 292/201 |
| 5,100,185 | A | 3/1992 | Menke et al. | |
| 5,439,261 | A * | 8/1995 | O'Hare | 292/336.3 |
| 5,476,294 | A * | 12/1995 | Menke | 292/216 |
| 5,494,322 | A * | 2/1996 | Menke | 292/216 |
| 5,538,298 | A * | 7/1996 | Ikeda | 292/201 |

(Continued)

FOREIGN PATENT DOCUMENTS

DE 10339542 A1 * 5/2005

OTHER PUBLICATIONS

German Patent Office, International Search Report, PCT application No. PCT/DE2008/001110, dated Nov. 26, 2008, 2 pages.

*Primary Examiner* — Kristina Fulton
*Assistant Examiner* — Alyson M Merlino
(74) *Attorney, Agent, or Firm* — Konomi Takeshita

(57) ABSTRACT

A motor vehicle door lock having a locking device (4, 5, 6), at least one actuating element (7) and a catch (1, 2), and having a coupling unit (8) between the actuating element (7) and the catch (1, 2), in which the locking device (4, 5, 6) when in the "locked" position can be unlocked by a first traveling movement (unlocking traveling movement) of the actuating element (7) and the catch (1, 2) can be opened by a second traveling movement (opening traveling movement) of the actuating element (7), wherein the locking device (4, 5, 6) has a drive element (4) which acts directly upon the coupling unit (8).

7 Claims, 4 Drawing Sheets

(56) References Cited

U.S. PATENT DOCUMENTS

| | | | | | |
|---|---|---|---|---|---|
| 5,577,782 | A * | 11/1996 | Johnson et al. | 292/216 |
| 5,615,564 | A * | 4/1997 | Inoue | 70/279.1 |
| 5,638,712 | A * | 6/1997 | Kuroda | 70/268 |
| 5,653,484 | A * | 8/1997 | Brackmann et al. | 292/216 |
| 5,683,125 | A * | 11/1997 | Tseng | 292/216 |
| 5,715,713 | A * | 2/1998 | Aubry et al. | 70/277 |
| 5,921,595 | A * | 7/1999 | Brackmann et al. | 292/216 |
| 5,961,163 | A * | 10/1999 | Brackmann et al. | 292/201 |
| 6,007,118 | A * | 12/1999 | Arabia et al. | 292/216 |
| 6,010,165 | A * | 1/2000 | Santarelli et al. | 292/216 |
| 6,053,543 | A * | 4/2000 | Arabia et al. | 292/201 |
| 6,109,079 | A * | 8/2000 | Ikeda | 70/264 |
| 6,123,371 | A * | 9/2000 | Fisher | 292/216 |
| 6,158,788 | A * | 12/2000 | Ikeda et al. | 292/216 |
| 6,328,353 | B1 * | 12/2001 | Barczynski et al. | 292/216 |
| 6,338,508 | B1 * | 1/2002 | Kleefeldt | 292/201 |
| 6,343,817 | B1 * | 2/2002 | Watanabe | 292/216 |
| 6,382,686 | B1 * | 5/2002 | Ishigaki et al. | 292/201 |
| 6,406,073 | B1 * | 6/2002 | Watanabe | 292/216 |
| 6,416,088 | B1 * | 7/2002 | Graute | 292/216 |
| 6,428,058 | B1 * | 8/2002 | Graute | 292/216 |
| 6,520,550 | B2 * | 2/2003 | Kunst et al. | 292/216 |
| 6,523,376 | B2 * | 2/2003 | Baukholt et al. | 70/256 |
| 6,568,722 | B2 * | 5/2003 | Raffelsiefer et al. | 292/216 |
| 6,607,222 | B2 * | 8/2003 | Inoue | 292/216 |
| 6,609,737 | B2 * | 8/2003 | Fisher | 292/216 |
| 6,824,177 | B1 * | 11/2004 | Nass et al. | 292/216 |
| 6,913,298 | B2 | 7/2005 | Inoue | |
| 7,055,872 | B2 * | 6/2006 | Hayakawa et al. | 292/216 |
| 7,080,861 | B2 * | 7/2006 | Watanabe | 292/216 |
| 7,125,057 | B2 * | 10/2006 | Coleman et al. | 292/216 |
| 7,243,960 | B2 * | 7/2007 | Hoshikawa et al. | 292/216 |
| 7,261,335 | B2 * | 8/2007 | Schupp | 292/201 |
| 7,293,806 | B2 * | 11/2007 | Umino | 292/216 |
| 7,311,340 | B2 * | 12/2007 | Baillet | 292/216 |
| 7,399,010 | B2 * | 7/2008 | Hunt et al. | 292/201 |
| 7,441,815 | B2 * | 10/2008 | Umino | 292/216 |
| 7,568,741 | B2 * | 8/2009 | Odahara | 292/216 |
| 7,770,945 | B2 * | 8/2010 | Umino | 292/201 |
| 7,931,312 | B2 * | 4/2011 | Mochizuki et al. | 292/216 |
| 2001/0035653 | A1 * | 11/2001 | Hayakawa et al. | 292/201 |
| 2004/0094971 | A1 * | 5/2004 | Warmke et al. | 292/201 |

* cited by examiner

MOTOR VEHICLE DOOR LOCK

CROSS REFERENCE TO RELATED APPLICATIONS

This application claims priority under 35 U.S.C. 119 and 35 U.S.C. 365 based upon German Patent Application No. 20 2007 009 441.8, filed on Jul. 5, 2007. The entire disclosure of the aforesaid application is incorporated herein by reference.

FIELD OF THE INVENTION

The invention relates to a motor vehicle door lock having a locking device, at least an actuating element and a catch, and a coupling unit, and in particular a motor vehicle door lock for taking up at least the "locked" and "unlocked" positions with a simple and cost-effective design.

BACKGROUND OF THE INVENTION

The invention relates to a motor vehicle door lock, having a locking device, at least an actuating element and a catch, and having a coupling unit between the actuating element and the catch, in which the locking device when in the "locked" position, can be unlocked by a first traveling movement (unlocking traveling movement) of the actuating element and the catch can be opened by a second traveling movement (opening traveling movement) of the actuating element.

Such a motor vehicle door lock is, for instance, disclosed in DE 39 08 183 C5, which provides a coupling lever spring connected to the coupling lever, tensioned by the first traveling movement or unlocking traveling movement. With the aid off the aforementioned coupling lever spring, the coupling lever can be moved from a disengaged position into an engaged position. The catch can consequently be opened by the second or opening traveling movement of the actuating element. The actuating element is in this case an internal operating lever. This is a generally tried and tested design.

In more recent times such motor vehicle door locks are increasingly often equipped with additional driving means in order, on one hand, to provide the central locking function and, on the other hand, to provide double locking functions. For this described double traveling movement function special design features are required. In fact, one or two intermediate levers have been used in practical applications, which require an elaborate mechanical design. This is where the invention aims to provide a solution.

The invention is based on the technical problem of further developing a motor vehicle door lock in such a way that a simple and cost-effective design is provided.

SUMMARY OF THE INVENTION

In order to solve this technical problem, a motor vehicle door lock of the type disclosed in the invention is characterized by the locking device having a coupling unit directly acting upon the drive element.

As usual, the locking device ensures that the motor vehicle door lock takes up at least the positions "locked" and "unlocked". In the "locked" position the coupling unit interposed between the actuating element and the locking mechanism ensures an idle state of the actuating element compared to the locking mechanism. This is the usual functionality in the "locked" position.

If the coupling unit is, on the other hand, in its coupled position, a continuous mechanical connection is provided between the actuating element and the locking mechanism.

This means that manipulating the actuating element causes the coupling unit to act on the locking mechanism so that it opens. In most cases the locking mechanism contains a rotary catch and a pawl, with the latter interacting with an actuating lever. The coupling unit now operates the actuating lever cooperating with the locking mechanism in this position (engaged position of coupling unit or "unlocked") in such a way that the catch is opened.—The actuating element can generally be an internal operating lever or an external operating lever.

According to an advantageous embodiment, the drive unit or the locking unit mainly consists of a drive motor and the drive element. The drive element directly interacts with the coupling unit without any intermediate elements or levers. In most cases, the drive element and the actuating element are located on the same axis and in parallel planes to each other.

In contrast, the drive unit or the locking device and the coupling unit are positioned in the same plane in order to ensure a simple interaction between the two aforementioned elements. In particular the drive unit contains an actuating contour interacting with the actuating pin on the coupling unit.

In most cases, the coupling unit is designed as at least a two-arm coupling lever with a triggering lever arm and an actuating lever arm. The actuating lever arm preferably contains the aforementioned actuating pin, acted upon by the actuating contour on the drive mechanism or locking device.

The aforementioned actuating contour is generally a drive element on a driving pulley of the drive mechanism. In a preferred embodiment, a driving worm driven by a motor, engages with this driving pulley. In this way, the driving pulley of the drive mechanism can rotate clockwise and counterclockwise.

As a result of this rotation of the drive mechanism, the coupling unit or the coupling lever realized at this point is directly acted upon as the actuating contour on the driving pulley directly acts on the actuating pin on the actuating lever arm of the coupling lever. Advantageously, the actuating contour has two parts including a free area and an actuating surface.

If the actuating pin is acted upon by the actuating surface of the actuating contour, this movement translates into the coupling lever being, for instance, moved from the unlocked into the locked position. This may correspond with a clockwise turn of the driving pulley. In order to now move the coupling lever or the whole motor vehicle lock from the "locked" position into the "not locked or unlocked" position, the actuating element is acted upon by a first traveling movement.

During this first traveling movement or the unlocking traveling movement of the actuating element, the actuating element ensures that the coupling unit leaves its formerly disengaged position (locking position) in relation to the locking mechanism and is moved into the engaged position. For this purpose the coupling unit advantageously contains a carrier pin engaging in the actuating recess of the actuating element. The first traveling movement or unlocking traveling movement now causes the carrier pin of the coupling unit or of the coupling lever to rest against an edge of the actuating recess in the actuating element or in the actuating lever, and in such a way that the coupling lever is moved from its disengaged into its engaged position.

At the same time, the drive or the drive element is moved along during this process and assumes its original position corresponding to the "unlocked" position. The coupling unit is now (again) in operative connection with the locking mechanism or its release lever arm is pivoted in such a way that during the next or second traveling movement or opening traveling movement it comes into contact or interacts with the release lever to open the catch as a whole. In other words, the second or opening traveling movement ensures that with the aid of the coupling unit the release lever lifts the pawl from the rotary catch so that it is moved into the open position by the spring.

This provides a cost-effective solution of simple design as the, drive mechanism or locking device acts directly on the coupling lever and no additional intermediate levers are required. In fact said coupling lever can be operated electromechanically via the drive mechanism or also manually in case of a failure of the drive mechanism with the aid of the actuating element. This is because of the interaction between the actuating element or the actuating lever and the coupling lever is provided by the carrier pin of the coupling unit engaging in the actuating recess of the actuating element. This occurs generally independently from an activation of the coupling unit or of the coupling lever by the drive mechanism, in which the actuating pin on the coupling unit interacts with the actuating contour on the driving pulley or the drive mechanism.

BRIEF DESCRIPTION OF THE DRAWINGS

Below, the invention is explained in detail with reference to a drawing showing only one example embodiment, in which.

DETAILED DESCRIPTION OF THE INVENTION

The figures show a motor vehicle door lock with a usual locking mechanism 1, 2. The locking mechanism 1, 2 comprises a rotary catch 1 and a cooperating pawl 2. Furthermore, a release lever 3 is provided which disengages the pawl 2 for opening the catch 1, 2, so that the rotary catch 1 can be opened by the spring. The rotary catch 1, the pawl 2 and the release lever 3 are all arranged perpendicularly to the plane of FIG. 1 and are rotatable around a common axis A.

Figure 1:
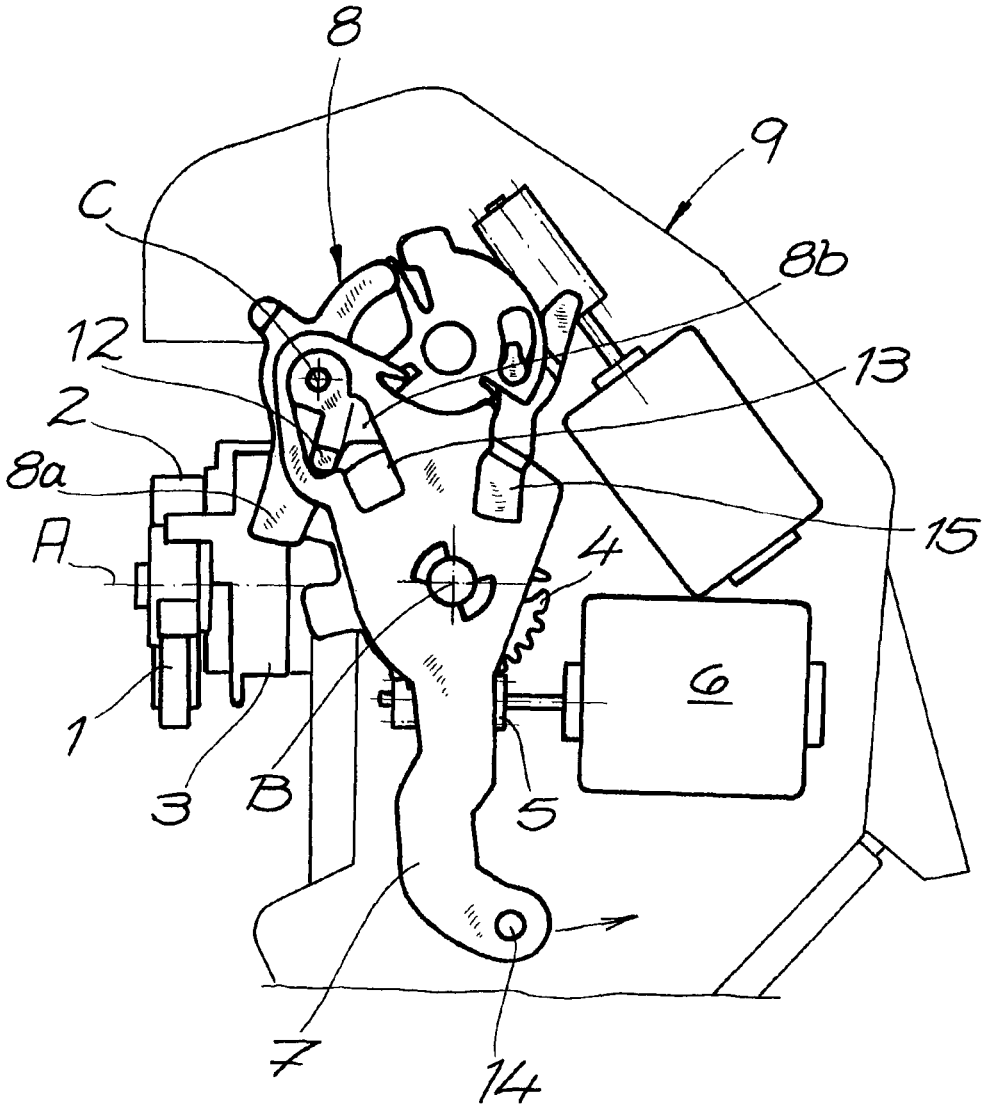
FIG. 1 provides an overview of the motor vehicle door lock of the invention.
Figure 2:
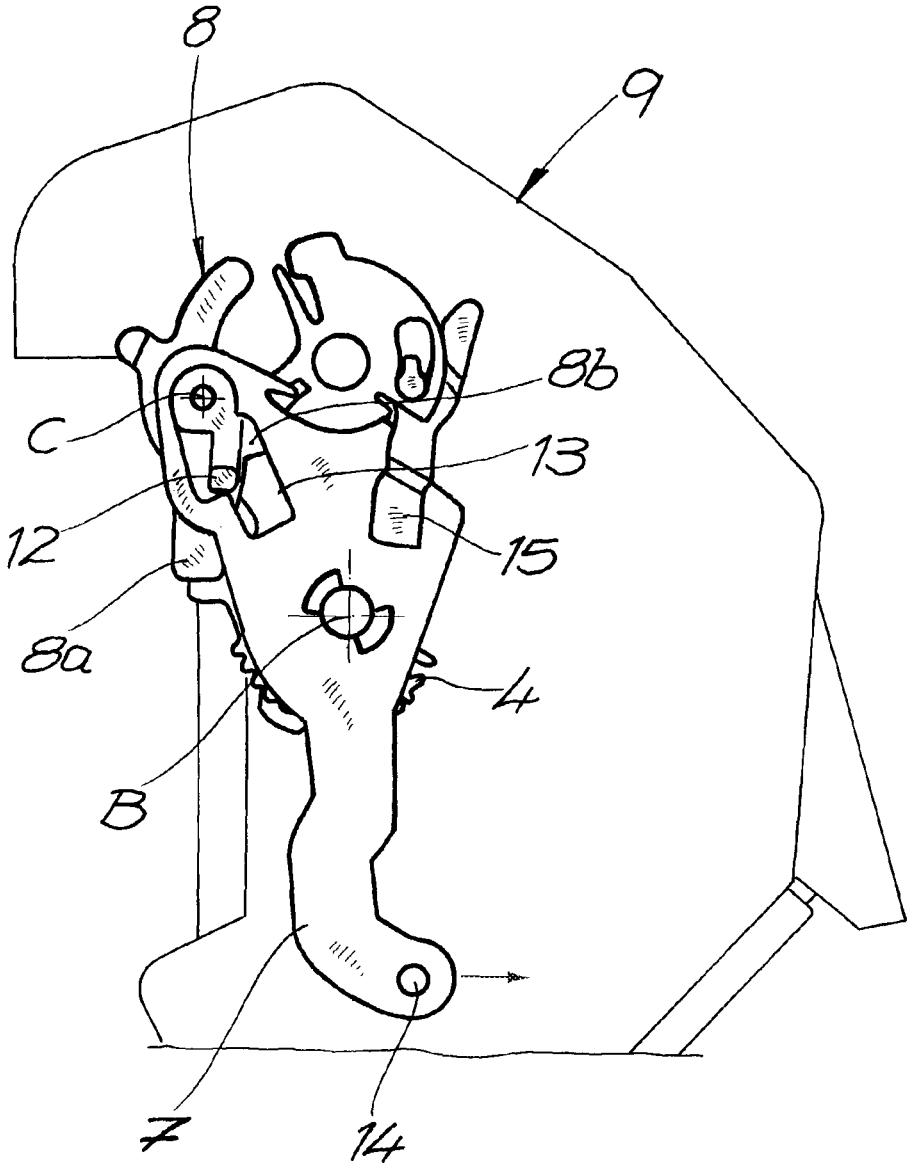
FIG. 2 shows the object of FIG. 1 reduced to the components of the invention in the "locked" position.
Figure 3:
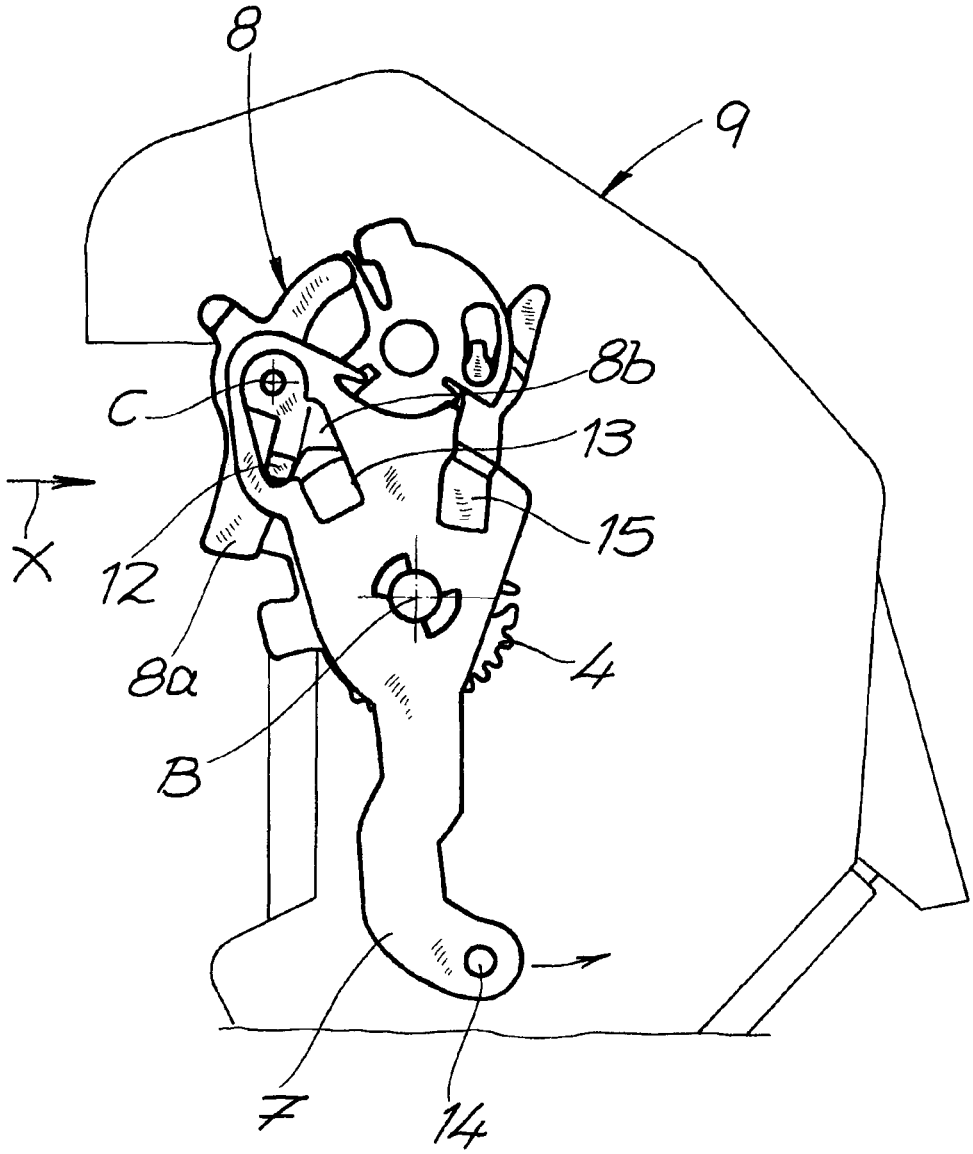
FIG. 3 shows the object of FIG. 1 in the "unlocked or not locked" condition.

In contrast, the other main components of the motor vehicle door lock, i.e. a locking device 4, 5, 6, an actuating element 7 and a coupling unit 8 are arranged in or parallel to the plane of FIGS. 1 to 3. In the illustration the actuating element 7 is an internal operating lever, although also an external operating lever or a main actuating lever can be used.

The drive mechanism or locking device 4, 5, 6 does, in particular, comprise a drive motor or electric motor 6, a driving worm 5 and a driving pulley 4 or a drive element 4. The driving worm 5 engages with the driving pulley 4 so that the driving pulley 4 can turn in clockwise and counterclockwise direction. In the embodiment of the example, the driving pulley 4 only rotates in clockwise direction although it is not limited to this.

The driving pulley 4 and the actuating element 7 or the internal operating lever 7 are located on a common axis B in a housing part 9 and preferably in the cover plate. Parallel to axis B, a further axis C is provided, seating the coupling unit or coupling lever 8. It is apparent that the coupling unit or the coupling lever 8 and the actuating element or the internal operating lever 7 are seated in parallel planes on axes C, B, offset from each other.

Figure 4:
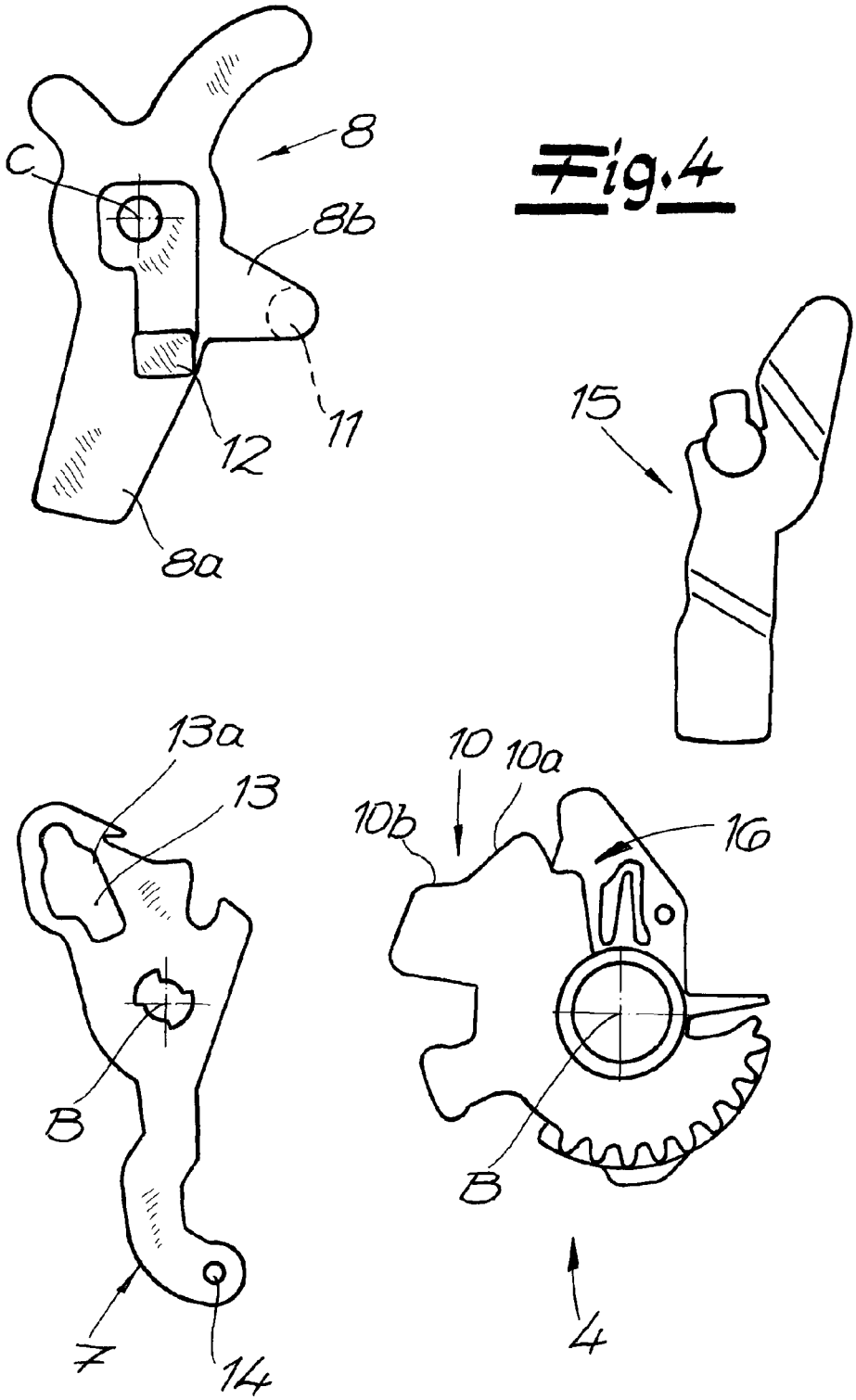
FIG. 4 shows the components of the invention in detail in an uninstalled condition.

FIG. 4 shows that the coupling unit 8 or the coupling lever 8 contains at least two arms, a release lever arm 8*a* and an actuating lever arm 8*b*. The coupling lever 8 also has two further arms, which at this point are, however, of no further relevance. The driving pulley 4 shown in FIG. 4 or the overall drive element 4, 5, 6 contains an actuating contour 10. The actuating contour 10 is made up of two parts, a free area 10*a* and an actuating surface 10*b*.

An actuating contour 10 interacts with actuating pin 11 on the coupling unit 8. In fact, the actuating pin 11 is in contact with the actuating surface 10*b* in the locked position as shown in FIG. 2, whilst in its unlocked position as shown in FIG. 3, the actuating pin 11 can move in relation to the free area 10*a*. The system operates as described below.

From the "unlocked" or "not locked" position shown in FIG. 3 a clockwise rotation of the driving pulley 4—initiated by the driving worm 5 rotated accordingly by the electric motor 6 and engaging in the driving pulley 4—ensures that the coupling unit 8 turns counterclockwise around its axis C.

As a result of the pivoting movement of the coupling unit or of the coupling lever 8 in counterclockwise direction, the release lever arm 8*a* of the coupling lever 8 is disengaged from the release lever 3 and pivoted towards the inside of the lock. In fact, the coupling lever 8 in the unlocked position shown in FIG. 3 is, with the aid of an opening movement initiated by the internal operating lever 7 able to pivot the release lever 3 clockwise around axis A, viewed from direction X in FIG. 3, so that the release lever 3 lifts the pawl 2 off the rotary catch 1. As a result, the rotary catch 1 can be turned by the spring around axis A into the open position and release a previously retained locking bolt. The catch 1, 2 is then open.

If, however, the coupling lever 8 and with it the motor vehicle door lock as a whole are moved to the "locked" position as a result of the counterclockwise movement of the coupling lever 8 during the transition from FIG. 3 to FIG. 2, a mechanical connection from the actuating lever 7 via the coupling lever 8 to the locking mechanism 1, 2 no longer exists, as in this "locked" position the actuating lever arm 8*a* has been pivoted out of its engagement with the release lever 3 and cannot act upon said lever in order to lift off the pawl 2. Respective movements of the actuating lever or of the internal operating lever 7 therefore do not have any effect or ensure that the coupling unit or the coupling lever 8 is moved by the first traveling movement of the actuating element or of the internal operating lever 7 into the "unlocked" position.

Consequently this first traveling movement is also called unlocking traveling movement. For this purpose, the coupling unit or the coupling lever 8 contains a carrier pin 12. The carrier pin 12 engages in an actuating recess 13 in the actuating element or in the internal operating lever 7, arranged above the coupling lever 8 on the common axis B. As the carrier pin 12 of the coupling lever 8 is pivoted from the "locked" position of FIG. 2 in clockwise direction, it ensures together with a stop edge 13*a* in the actuating recess 13 of the internal operating lever 7 that the coupling lever 8 moves during this operation from the "locked" position of FIG. 2 to the "unlocked" position of FIG. 3. The internal operating lever 7 is moved by a Bowden cable connected to a connection point 14 of the internal operating lever 7 and acts upon said lever by pulling it (see arrow in FIG. 2).

After the described first traveling movement or unlocking traveling movement of the actuating element or of the internal operating lever 7, the coupling lever 8 is in its "unlocked" position as shown in FIG. 3. The same applies to the motor vehicle door lock as a whole. During this operation, the driving pulley 4 is also moved around its axis B in counterclockwise direction. This is apparent when comparing FIGS. 2 and 3.

This counterclockwise movement of the driving pulley 4 is achieved by a lever or an override lever 15 interacting with a respective contour 16. Said lever 15 is indeed seated in or on the driving pulley 4 and is at the same time carried along by the actuating element 7. This results in a pulling movement—starting from the "locked" position in FIG. 2—of the actuating element or internal operating lever 7 on connection point 14 so that the lever or override lever 15 acts upon the respective contour 16 in such a way that the driving pulley 4 moves in counterclockwise direction during the transition from FIG. 2 to FIG. 3.

The motor vehicle door lock is now in the "unlocked" position of FIG. 3. By pulling again on the actuating element or the internal operating lever 7 in the direction of the shown arrow, a further second traveling movement ensures that the locking mechanism 1, 2 is opened. This second traveling movement is consequently referred to as the opening traveling movement. Using its actuating lever arm 8*a* the coupling lever 8, now in the "unlocked" position, can now pivot the release lever 3, as viewed from direction X, around axis A, disengaging the pawl 2 and allowing the spring to release the rotary catch 1 to open the locking mechanism 1,2.

What is claimed is:

1. A motor vehicle door lock comprising:

a locking mechanism having a locked state and an unlocked state;

a locking device comprising a drive motor and a driving worm directly engaging a drive element;

at least one actuating element;

a release lever pivotable to place the locking mechanism in the unlocked state; and a coupling unit between the at least one actuating element and the release lever, and movable between a first position and a second position, wherein the coupling unit contains a carrier pin engaging in an actuating recess of the at least one actuating element and the coupling unit engaging with the release lever when the coupling unit is in the second position, wherein when the drive element of the locking device is in a locked position, the drive element is placed in an unlocked position by a first traveling movement of the at least one actuating element in a first rotational direction, and the coupling unit is moved to the second position to engage the release lever by a second traveling movement of the at least one actuating element in a second rotational direction opposite to the first rotational direction, wherein the drive element acts directly upon the coupling unit via an actuating contour of the drive element, such that the actuating contour interacts with an actuating pin on the coupling unit, and the drive element and the at least one actuating element share an identical, common axis, which extends through an approximately central main body area of both the drive element and the at least one actuating element.

2. The motor vehicle door lock according to claim 1, wherein the locking device and the coupling unit are arranged in the same plane.

3. The motor vehicle door lock according to claim 1 wherein the coupling unit and the at least one actuating element are seated in parallel planes on axes offset from each other.

4. The motor vehicle door lock according to claim 1 wherein the coupling unit operates the release lever cooperating with a catch of the locking mechanism.

5. The motor vehicle door lock according to claim 1 wherein the coupling unit is at least a two-arm coupling lever with a release lever arm and an actuating lever arm.

6. The motor vehicle door lock according to claim 5, wherein the actuating lever arm contains the actuating pin, acted upon by the actuating contour of the drive element.

7. The motor vehicle door lock according to claim 6, wherein the actuating contour is made up of two parts, a free area and an actuating surface.

* * * * *